US005351370A

United States Patent [19]

Fields et al.

[11] Patent Number: 5,351,370

[45] Date of Patent: Oct. 4, 1994

[54] BOOTLACE STORAGE DEVICE

[76] Inventors: Lorenzo Fields; Lynne Fields, both of 3001 Persimmon Dr., Killeen, Tex. 76543

[21] Appl. No.: 139,767

[22] Filed: Oct. 22, 1993

[51] Int. Cl.[5] ..... A44B 18/00; A43C 7/00

[52] U.S. Cl. ..... 24/306; 24/301; 24/442; 24/712.1

[58] Field of Search ..... 24/306, 300, 301, 302, 24/712.1, 712.3, 712.9, 713.6, 713.9, 714, 714.1, 714.6, 442; 36/1, 50.1

[56] References Cited

U.S. PATENT DOCUMENTS

| | | | |
|---|---|---|---|
| 562,114 | 6/1896 | Benford | 24/713.9 |
| 2,832,358 | 4/1958 | Chambers | 24/301 |
| 4,158,906 | 6/1979 | Watson | 24/306 |
| 4,937,920 | 6/1990 | Tsai | 24/442 |
| 5,016,327 | 5/1991 | Klausner | 36/50.1 |
| 5,029,371 | 7/1991 | Rosenblood et al. | 24/712.9 |
| 5,042,119 | 8/1991 | Williams | 24/442 |
| 5,170,573 | 12/1992 | Clinch | 24/306 |

*Primary Examiner*—Victor N. Sakran
*Attorney, Agent, or Firm*—E. Michael Combs

[57] ABSTRACT

A flexible elastomeric web is arranged for securement about the upper portion of a boot adjacent the entrance opening for securement to the opposed side edges of the lacing slot to receive the boot laces therewithin for storage.

2 Claims, 4 Drawing Sheets

BOOTLACE STORAGE DEVICE

BACKGROUND OF THE INVENTION

1. Field of the Invention

The field of invention relates to bootlace storage devices, and more particularly pertains to a new and improved bootlace storage device wherein the same is arranged for ease storage and securement prior to a lacing procedure.

2. Description of the Prior Art

Various boots such as work boots, military boots, and the like are provided with laces of greater length than required subsequent to a lacing procedure. To this end, the instant invention attempts to overcome various deficiencies in the prior art by providing for a convenient, flexible, and elastomeric member arranged for securement relative to a boot to store such extra lacing portions subsequent to the lacing procedure.

Prior art locking devices are indicated in the prior art relative to boot laces, shoe laces, and the like such as indicated in U.S. Pat. No. 9,029,37, as well as maintaining a knot relative to a shoe pair such as indicated in U.S. Pat. No. 4,715,094. U.S. Pat. No. 3,529,367 indicates a lace holder to store extra laces relative to a shoe.

SUMMARY OF THE INVENTION

In view of the foregoing disadvantages inherent in the known types of bootlace devices now present in the prior art, the present invention provides a bootlace storage device wherein the same is arranged to secure and position bootlaces therein subsequent to a boot lacing procedure. As such, the general purpose of the present invention, which will be described subsequently in greater detail, is to provide a new and improved bootlace storage device which has all the advantages of the prior art boot lacing devices and none of the disadvantages.

To attain this, the present invention provides a flexible elastomeric web arranged for securement about the upper portion of a boot adjacent the entrance opening for securement to the opposed side edges of the lacing slot to receive the boot laces therewithin for storage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bootlace storage device which has all the advantages of the prior art bootlace devices and none of the disadvantages.

It is another object of the present invention to provide a new and improved bootlace storage device which may be easily and efficiently manufactured and marketed.

It is a further object of the present invention to provide a new and improved bootlace storage device which is of a durable and reliable construction.

An even further object of the present invention is to provide a new and improved bootlace storage device which is susceptible of a low cost of manufacture with regard to both materials and labor, and which accordingly is then susceptible of low prices of sale to the consuming public, thereby making such bootlace storage devices economically available to the buying public.

Still yet another object of the present invention is to provide a new and improved bootlace storage device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
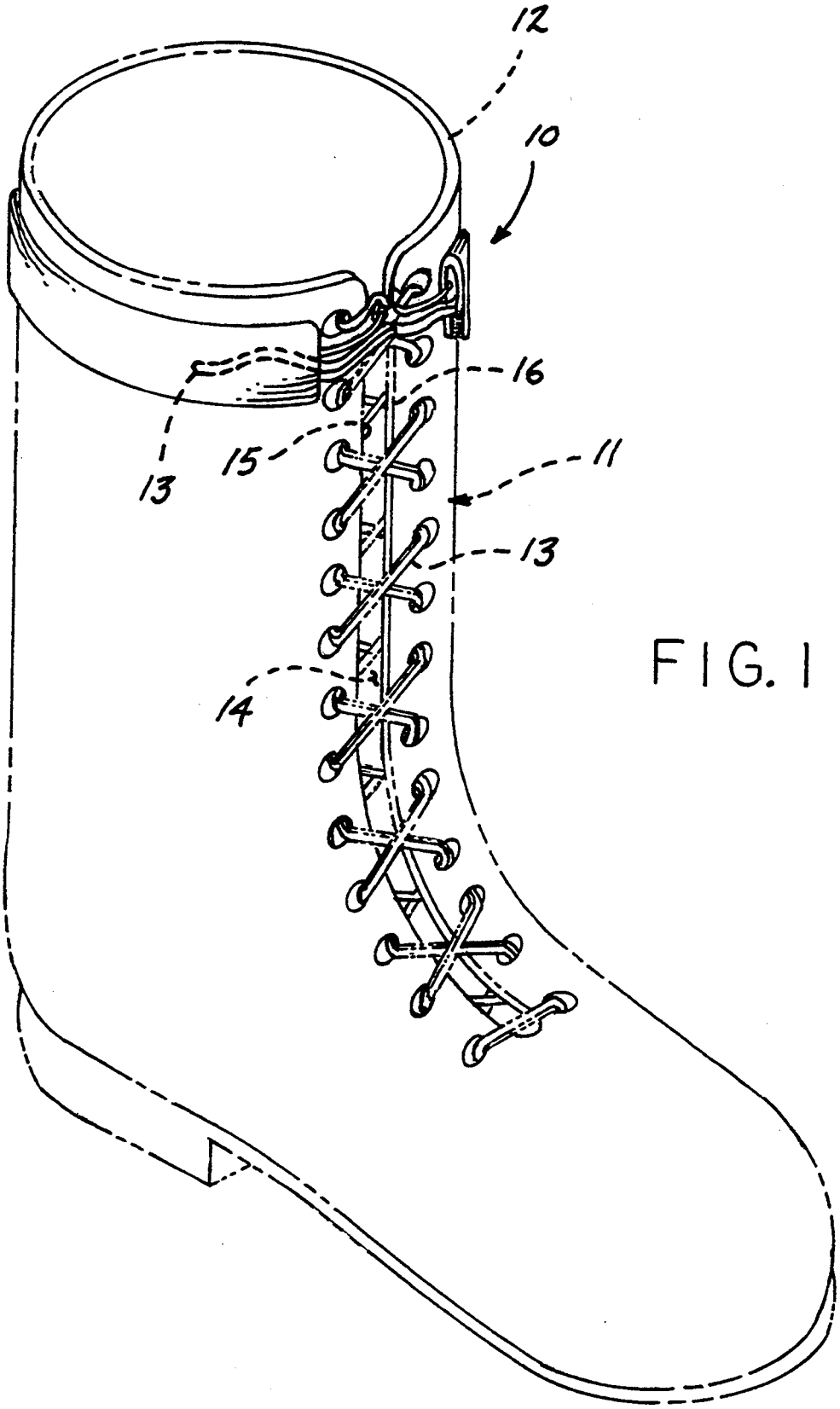
FIG. 1 is an isometric illustration of the invention in use.

With reference now to the drawings, and in particular to FIGS. 1 to 7 thereof, a new and improved bootlace storage device embodying the principles and concepts of the present invention and generally designated by the reference numeral 10 will be described.

Figures 2, 3:
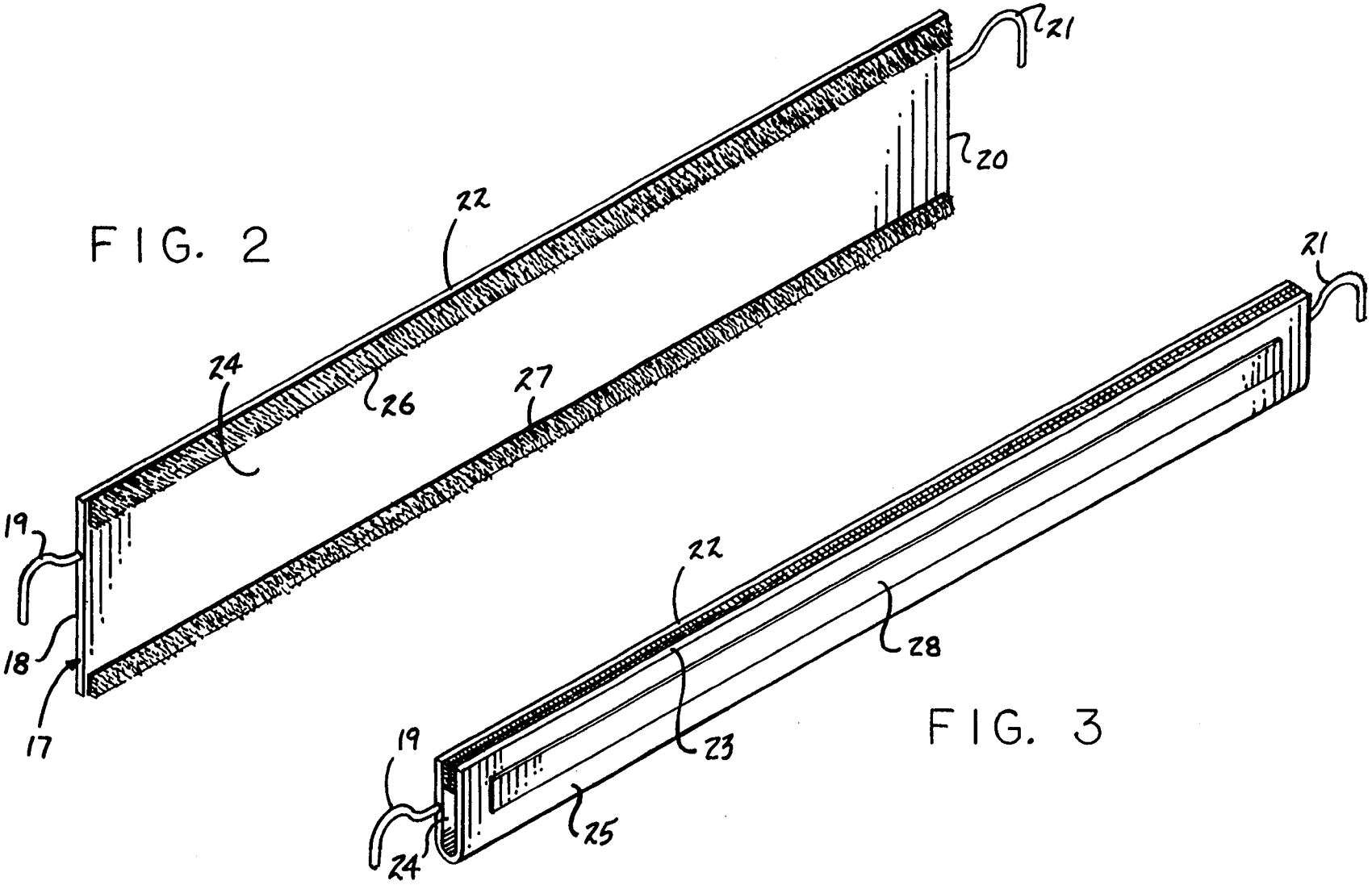
FIG. 2 is an isometric illustration of the invention in an opened configuration.
FIG. 3 is an isometric illustration of the invention in an interlocked configuration.

More specifically, the bootlace storage device 10 of the instant invention essentially comprises cooperation with a boot member 11, such as indicated in FIG. 1, having a boot entrance end 12 relative to a boot uppermost portion. Bootlaces 13 are secured to extend over a lacing slot 14, having slot first and second side edges 15 and 16 arranged in a facing relationship relative to one another. An elastomeric web 17 (see FIGS. 2 and 3 for example) includes an elastomeric web first end edge having a first hook 19 mounted thereto, with an elastomeric web second end edge 20 having a second hook 21 extending therefrom for attachment to the slot first and second side edges 15 and 16, such as indicated in FIG.1. In this manner, the elastomeric web structure is secured relative to the boot, as indicated in FIG. 1. The elastomeric web 17 is further formed with a first side edge 22 spaced from a second side edge 23 and a first side wall 24 spaced from a second side wall 25. A first hook and loop fastener strip 26 extends along and substantially coextensively along the first side edge 22 in contiguous communication therewith, with a second hook and loop fastener strip 27 extending substantially coextensively with the second side edge 23 permitting overfolding of the web structure relative to itself, such as indicated in FIG. 3, to permit positioning of extending bootlaces into the thusly formed overfolded web structure within the first side wall 24, such as illustrated in FIG. 1. A reflective strip 23 adhesively and accordingly removably mounted relative to the second side wall in adjacency to the second side edge 23 is provided. In this manner, when the web 17 is overfolded, such as illustrated in FIG. 3, the reflective strip is available, but should such visibility not be desired, such is readily removed relative to the adhesive mounting of the reflective strip structure. Accordingly, adhesives permitting such removal that are commercially available are to be employed.

Figure 5:
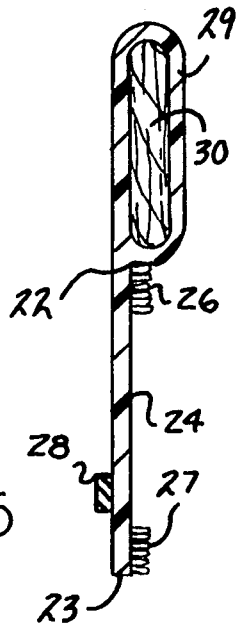
FIG. 5 is an orthographic view, taken along the lines 5—5 of FIG. 4 in the direction indicated by the arrows.
Figure 4:
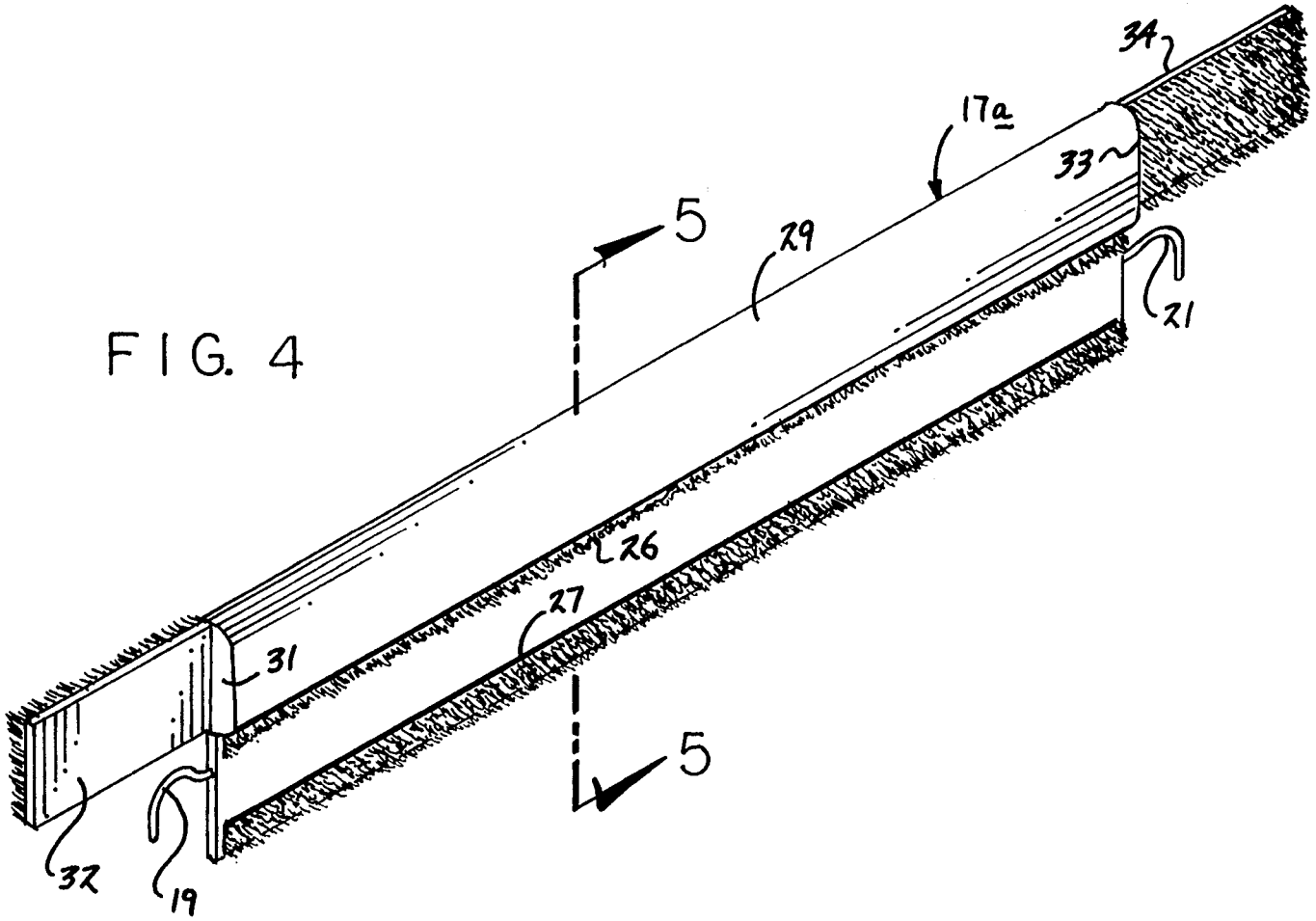
FIG. 4 is an isometric illustration of the invention including an abutment tube.
Figures 6, 7:
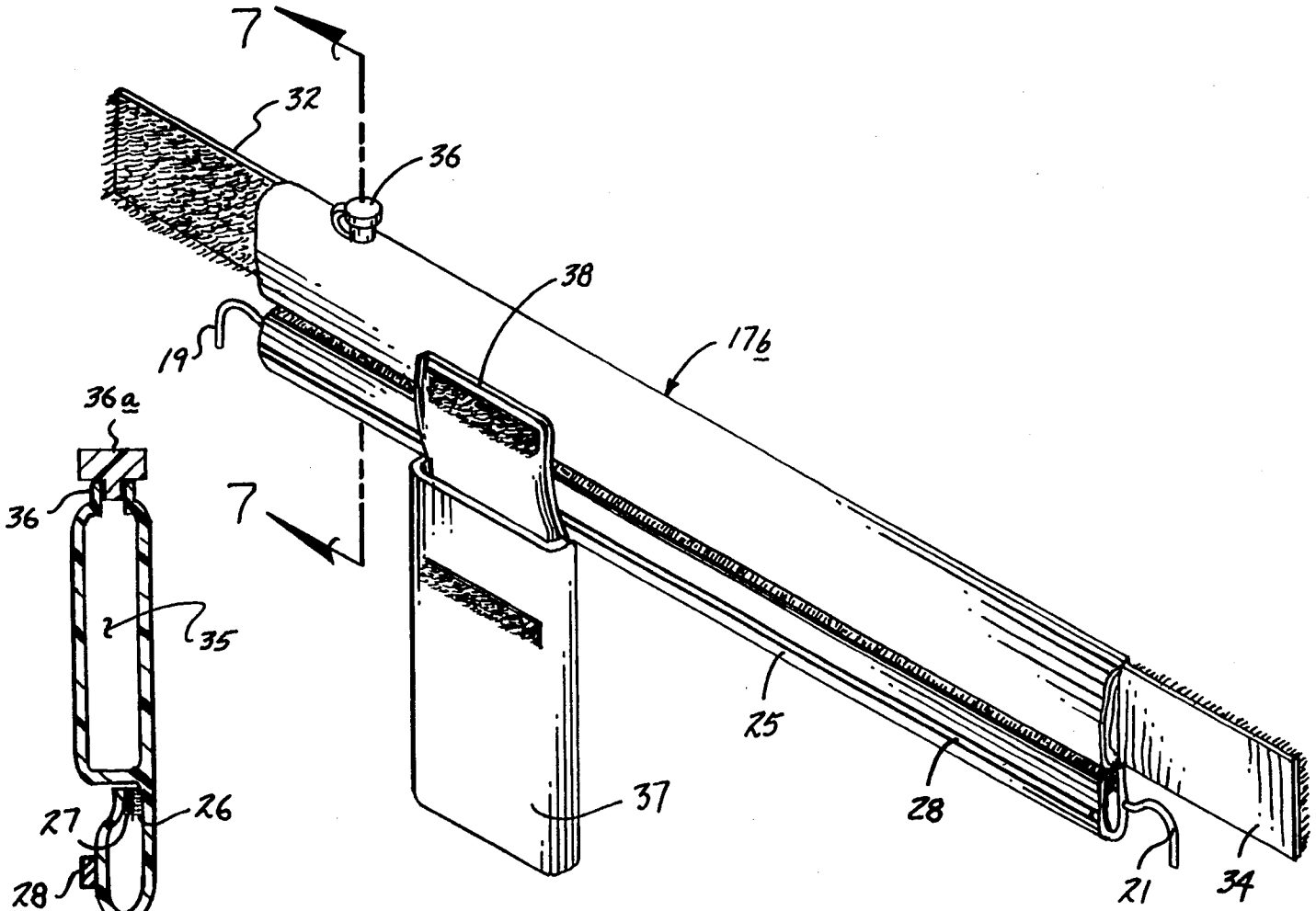
FIG. 6 is an isometric illustration of a further modified abutment tube structure.
FIG. 7 is an orthographic view, taken along the lines 7—7 of FIG. 6 in the direction indicated by the arrows.

The FIGS. 4 and 5 indicates the use of a modified web 17*a* to include a tube member 29 coextensively mounted along the first side edge 22, such as illustrated in the FIGS. 4 and 5. In this manner, when the web is overfolded, the web is not permitted to continue to overfold and to this end, the tube 29 is formed with tube first and second ends 31 and 33 having respective first and second hook and loop fastener flaps 32 and 34 that are arranged for securement relative to one another to provide for an abutting tube structure preventing the web 17*a* from "creeping" along the shoe upper by providing for a secure fastening of the tube that in turn is filled with a resilient core 30. Alternatively, the tube 29 may be formed with a pneumatic chamber 35 in lieu of the resilient core 30 permitting inflation of the tube by the inflation nozzle 36 providing for selective sizing of the tube due to the elastomeric construction of the further modified web 17*b*, as illustrated in FIG. 6. Furthermore, a storage pouch 37 is arranged for securement to the second side wall 25 having a storage pouch flap 38 for storage of various articles, such as a key, additional lacing members 13, and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bootlace storage device arranged for securement about a boot member, wherein the device comprises, an elastomeric web having a web first end edge fixedly mounting a first hook thereto, with a web second end edge having a second hook mounted fixedly thereto, a web first side edge spaced from a web second side edge, and a web first side wall spaced from a web second side wall, with the first side wall including a first hook and loop fastener strip extending along the web first side edge between the web first end edge and the web second end edge, and second hook and loop fastener strip mounted to the first side wall extending between the web first end edge and the web second end edge, and a reflective strip adhesively mounted to the web second side wall in spaced adjacency to the web second end edge, and further comprising a tube member mounted fixedly and coextensively along the web first side edge, and the tube member includes a tube first end and a tube second end, with the tube first end positioned in a colinear relationship relative to the web first end edge, and a tube second end edge arranged in a colinear relationship relative to the web second end edge, with a first hook and loop fastener flap mounted to the tube first end and a second hook and loop fastener flap mounted to the tube second end, and the tube member includes a pneumatic chamber coextensive with the tube member, and an inflation nozzle mounted into the tube member to effect selective inflation of the pneumatic chamber.

2. A bootlace storage device as set forth in claim 7 further comprising a storage pouch mounted to the second side wall, having a storage pouch flap.

* * * * *